US005780154A

United States Patent [19]

Okano et al.

[11] Patent Number: 5,780,154

[45] Date of Patent: Jul. 14, 1998

[54] BORON NITRIDE FIBER AND PROCESS FOR PRODUCTION THEREOF

[75] Inventors: Yoshio Okano; Hiroya Yamashita, both of Tsukuba, Japan

[73] Assignee: Tokuyama Corporation, Yamaguchi, Japan

[21] Appl. No.: 556,985

[22] PCT Filed: Mar. 20, 1995

[86] PCT No.: PCT/JP95/00500

§ 371 Date: Nov. 22, 1995

§ 102(e) Date: Nov. 22, 1995

[87] PCT Pub. No.: WO95/25834

PCT Pub. Date: Sep. 28, 1995

[30] Foreign Application Priority Data

Mar. 22, 1994 [JP] Japan ..... 6-050779

[51] Int. Cl.[6] ..... B32B 9/00

[52] U.S. Cl. ..... 428/366; 428/364; 264/345; 264/346; 501/95.1

[58] Field of Search ..... 428/364, 367, 428/366; 509/95.1, 94.4; 264/345, 346

[56] References Cited

U.S. PATENT DOCUMENTS

| | | | |
|---|---|---|---|
| 3,668,059 | 6/1972 | Economy et al. | 161/170 |
| 4,707,556 | 11/1987 | Paciorek et al. | 556/403 |
| 5,061,469 | 10/1991 | Kimura | 423/290 |

FOREIGN PATENT DOCUMENTS

| | | |
|---|---|---|
| 53-37837 | 10/1978 | Japan . |
| 63-195173 | 8/1988 | Japan . |
| 1-97213 | 4/1989 | Japan . |
| 1-290510 | 11/1989 | Japan . |
| 2-74614 | 3/1990 | Japan . |
| 4-272231 | 9/1992 | Japan . |
| 5-310404 | 11/1993 | Japan . |

OTHER PUBLICATIONS

Fazen et al. "Thermally Induced Borazine Dehydropolymerization Reactions. Synthesis And Ceramic Conversion Reactions Of A New High–Yield Polymeric Precursor To Boron Nitride", *Chemistry of Materials*, vol. 2, 96–97 (1990).

Lynch et al., "Transition–Metal–Promoted Reactions Of Boron Hydrides. 10.[1] Rhodium–Catalyzed Syntheses Of B–Alkenylborazines", *Journal of American Chemical Society*, vol. 109, 5867–5868 (1987).

Rees, Jr., et al., "High–Yield Synthesis Of $B_4C$/BN Ceramic Materials By Pyrolysis Of Polymeric Lewis Base Adducts Of Decaborane(14)", *Journal of America Ceramic Society*, vol. 71, C194 (1988).

*Primary Examiner*—Marion E. McCamish
*Assistant Examiner*—J. M. Gray
*Attorney, Agent, or Firm*—Wenderoth, Lind & Ponack

[57] ABSTRACT

A boron nitride fiber comprising hexagonal and/or turbostratic boron nitride having C planes oriented substantially parallel to the fiber axis and a degree of orientation of 0.74 or above can be obtained by heating an adduct between a boron trihalide such as boron trichloride or the like and a nitrile compound such as acetonitrile, benzonitrile or the like, and an ammonium halide or a primary amine hydrohalide in the presence of a boron trihalide at around 125° C. to form a boron nitride precursor, dissolving the boron nitride precursor in a solvent such as N,N'-dimethyl formamide or the like, capable of dissolving the precursor, spinning the solution to obtain a boron nitride precursor fiber, heat-treating the precursor fiber in an inert gas atmosphere and then in an ammonia gas atmosphere to obtain a boron nitride fiber, and heat-treating the boron nitride fiber with a tensile stress being applied to the fiber. The boron nitride fiber of the present invention has a degree of orientation of 0.74 or above and therefore has a high tensile strength.

40 Claims, 2 Drawing Sheets

BORON NITRIDE FIBER AND PROCESS FOR PRODUCTION THEREOF

TECHNICAL FIELD

The present invention relates to a boron nitride fiber and a process for production thereof.

More particularly, the present invention relates to a boron nitride fiber having a tensile strength larger than that of any boron nitride fiber known heretofore, as well as to a process for production of the fiber.

BACKGROUND ART

Boron nitride fibers are known. None of known boron nitride fibers, however, has a sufficiently large tensile strength, and no boron nitride fiber having a sufficiently large tensile strength is known yet.

A boron nitride fiber having a sufficiently large strength can be used, for example, as a reinforcing fiber for ceramic material.

Ceramic materials, having a high strength and moreover being stable up to high temperatures, are expected to be applied as a high-temperature structural material which no plastic or metal material can replace. While the ceramic materials have excellent thermal and mechanical properties, they have inherent brittleness which causes cracking easily. Owing to this inherent brittleness of ceramic, fracture of ceramic takes place catastrophically. Therefore, the ceramic materials are not reliable for use as a structural material which must retain a given structure, and are not in wide use.

In order to overcome the brittleness of ceramic, it is effective to blend a ceramic with a reinforcing material to convert the ceramic into a composite material having an improved toughness. As the reinforcing material, there have been studied spherical particles, platy particles, whiskers, continuous fibers, etc. It is particularly effective to blend a ceramic with a continuous fiber for improved toughness, and it is known that the method can increase the fracture toughness of a ceramic to about the same level as that of aluminum alloy. Prospective continuous fibers used as a reinforcing material for converting a ceramic into a composite material are ceramic fibers (e.g. a silicon carbide fiber and an alumina fiber) and a carbon fiber.

Both the ceramic fibers and the carbon fiber, however, have respective drawbacks and are not fully satisfactory as a fiber used as a reinforcing material for converting a ceramic into a composite material. For example, the ceramic fibers, which have a polycrystalline structure consisting of fine crystals, come to possess a significantly reduced tensile strength caused by the growth of the crystals when the ceramic fibers are exposed to high temperatures. In general, when a reinforcing fiber is blended with a ceramic to obtain a composite material, it is necessary to heat them at a high temperature of one thousand and several hundred degrees (centigrade) or above. As a result, a ceramic fiber, when used as a reinforcing material for ceramic to obtain a composite material, causes reduction in tensile strength during the process for obtaining the composite material and it is difficult to obtain a composite material of improved toughness.

Meanwhile, the carbon fiber exhibits little structural change at high temperatures and retains its tensile strength even when heated to about 2,000° C. Consequently, after the heat treatment to obtain a carbon fiber reinforced ceramic matrix composite, the carbon fiber can retain its strength, which makes it possible to use a carbon fiber as a reinforcing material for ceramic matrix composite material of improved toughness. However, the carbon fiber is oxidized and loses its weight in air at temperatures of about 400° C. or above; therefore, the resulting carbon fiber-reinforced ceramic cannot be used at high temperatures in air or in an oxidizing atmosphere.

Thus, there is not yet developed any reinforcing fiber capable of reinforcing a brittle material (e.g. ceramic) and endowing the material with high toughness without impairing the useful properties of the material.

In contrast, a boron nitride fiber, when containing no impurity (e.g. boron oxide) which promotes crystal growth, hardly exhibits structural change (e.g. gram growth of crystals) even at high temperatures and is presumed to give little reduction in tensile strength when exposed to high temperatures. That is, the reduction in tensile strength of boron nitride fiber caused by an exposure to high temperatures is presumed to be smaller than that of ceramic fiber. Moreover, the boron nitride is stable to oxidation in air up to about 1,000° C. and, as compared with a carbon fiber, has superior oxidation resistance.

In addition to the excellent heat resistance and oxidation resistance, the boron nitride fiber has excellent properties when used as a reinforcing fiber for obtaining a composite material. For example, the boron nitride has low reactivity with other substances, as appreciated from the fact that it is used as a material for crucibles or as a releasing agent. Therefore, it is thought that when combined with various ceramics, the boron nitride does not react with any matrix phase and can give a composite material.

The reason why a brittle material such as ceramic or the like can improve its fracture toughness when blended with a continuous fiber to convert into a composite material, is presumed to be that the mechanical energy applied to the composite material is absorbed by a "pull-out" phenomenon that the reinforcing fiber is pulled out from the matrix phase of the composite material at around the crack tip. The boron nitride fiber, having low reactivity with the matrix phase as mentioned above, does not bond to the matrix phase strongly in many cases. In addition, since the boron nitride fiber, has excellent solid lubricating properties, it is presumed that, when the boron nitride fiber is used as a reinforcing fiber to obtain a composite material, the "pull-out" phenomenon takes place easily and large improvement in fracture toughness can be obtained.

The promotion of "pull-out" by weak bonding to matrix phase and solid lubricating properties and consequent improvement in fracture toughness as mentioned above is expected also in a carbon fiber. However, the conditions under which the carbon fiber can be used, are restricted, for example, because it undergoes oxidation and dissipation in air at about 500° C. and because it has a high electrical conductivity.

Meanwhile, when a ceramic fiber such as alumina fiber, mullite fiber, silicon carbide fiber, silicon nitride fiber or the like is combined with a brittle material such as ceramic or the like to obtain a composite material, the bonding between the matrix phase and the fiber is strong in many cases. As a result, the "pull-out" phenomenon hardly occurs in such a composite material and no improvement in fracture toughness is obtained in many cases.

Also, the boron nitride fiber has, in addition to the above-mentioned properties when used as a reinforcing fiber, excellent properties such as high electrical resistance, high thermal shock resistance, high thermal conductivity and the like, leading to a material of high industrial utility.

For production of a boron nitride fiber, there is known a process which comprises spinning a boron nitride precursor containing boron and nitrogen and then heat-treatment of the resulting boron nitride precursor fiber to be pyrolyzed and converted into a boron nitride fiber (the process may hereinafter be referred to as precursor process); and a process which comprises heat-treatment of a boron oxide fiber in an ammonia atmosphere to nitride the fiber (this process may hereinafter be referred to as nitriding process).

As the precursor process among the processes for production of boron nitride fiber, there are known processes which comprise spinning a precursor fiber from a polycondensate of borazine or borazine derivative and then heat-treating the precursor fiber [Japanese Patent Publication No. 37837/1978, Japanese Patent Application Kokai (Laid-Open) No. 195173/1988, U.S. Pat. No. 5,061,469, U.S. Pat. No. 4,707,556, Chemistry of Materials, Vol. 2, 96–97 (1990), or Journal of American Chemical Society, Vol. 109, 5867–5868 (1987)]; and a process which comprises spinning a precursor fiber from a borane-amine adduct and then heat-treating the precursor fiber [Journal of American Ceramic Society, Vol. 71, C194 (1988)]. Of the boron nitride fibers obtained in these precursor processes, only those obtained in Japanese Patent Publication No. 37837/1978, Japanese Patent Application Kokai (Laid-Open) No. 195173/1988 and U.S. Pat. No. 5,061,469 (none of these fibers is subjected to any thermal stretching treatment under the application of a tensile stress) are measured for tensile strength, and their tensile strengths are 784 MPa, 500 MPa and 1,200 MPa, respectively. These tensile strengths are low as compared with, for example, the tensile strength 3,000 MPa or above of a carbon fiber. No particular means for increasing the tensile strengths is indicated in the above three literatures. In other precursor processes, only the possibility of boron nitride fiber production is described and no examination is made on the properties (e.g. tensile strength) of the boron nitride fiber obtained.

Meanwhile, in the process which comprises heat-treating a boron oxide fiber in an ammonia atmosphere to nitride the fiber to obtain a boron nitride fiber (U.S. Pat. No. 3,668,059), it is indicated that by partly nitriding a boron oxide fiber and subjecting the partly nitrided boron oxide fiber to thermal stretching and nitriding simultaneously, a boron nitride fiber of improved tensile modulus of elasticity can be obtained. The literature gives no detailed reason for this improved tensile modulus of elasticity but points out the small diameter of fiber resulting from thermal stretching, as an important factor of improved modulus. The tensile modulus of elasticity of this boron nitride fiber, however, is not significantly improved as compared with the tensile modulus of elasticity of the boron nitride fiber obtained by the precursor process. Also in this boron nitride fiber, the maximum tensile strength shown in Examples is 580 MPa although the fiber is stretched and has a diameter as small as 6 μm or less, and is not significantly improved as compared with the tensile strength of the boron nitride fiber obtained by the precursor process. Thus, although many studies such as mentioned above have been made, the boron nitride fibers obtained heretofore have no sufficient tensile strength for reinforcement of brittle material; moreover, means for obtaining a boron nitride fiber of high strength are not yet developed and the research therefor has been stagnant.

DISCLOSURE OF THE INVENTION

Hence, an object of the present invention is to provide a boron nitride fiber having a large tensile strength.

A further object of the present invention is to provide a process for producing a boron nitride fiber having a large tensile strength.

According to the present invention, the former object can be achieved by a boron nitride fiber comprising boron nitride having a multi-layered structure consisting of planes (C planes) each formed by linkage of 6-membered rings in the plane, in which boron and nitrogen are positioned alternately and bonded to each other, which fiber has a tensile strength of at least 1,400 MPa.

According to the present invention, the former object can also be achieved by a boron nitride fiber comprising boron nitride having a multi-layered structure consisting of planes (C planes) each formed by linkage of 6-membered rings in the plane, in which boron and nitrogen are positioned alternately and bonded to each other, in which fiber at least part of each C plane is oriented substantially parallel to the fiber axis and the degree of orientation of each C plane is at least 0.74.

According to the present invention, the latter object can be achieved by a process for producing a boron nitride fiber, which comprises:

(a) reacting a boron trihalide-nitrile compound adduct with an ammonium halide or a primary amine hydrohalide in the presence of a boron trihalide to form a boron nitride precursor, (b) dissolving the boron nitride precursor in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

According to the present invention, the latter object can also be achieved by a process for producing a boron nitride fiber, which comprises:

(a) reacting a boron trihalide-nitrile compound adduct with an ammonium halide or a primary amine hydrohalide in the presence of a boron trihalide to form a boron nitride precursor, (b) dissolving the boron nitride precursor and an acrylonitrile polymer in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

BEST MODE FOR CARRYING OUT THE INVENTION

Figure 1:
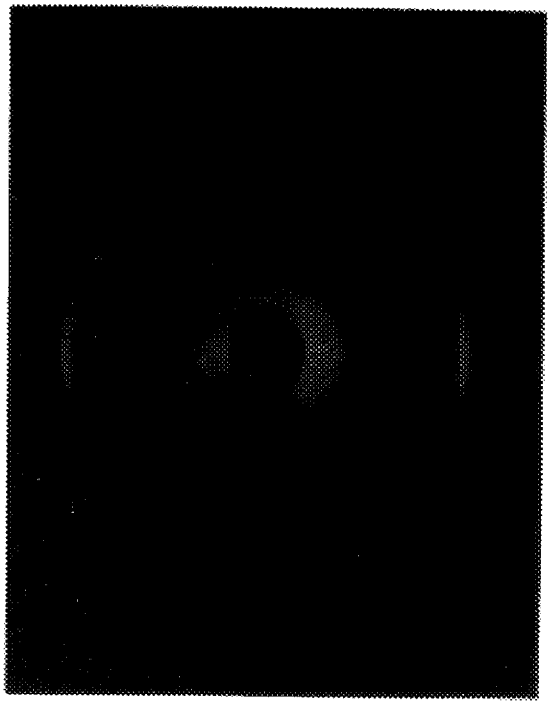
FIG. 1 is a photograph of a diffraction pattern obtained when a boron nitride fiber of the present invention obtained by heating an ammonia-treated boron nitride fiber in a nitrogen gas atmosphere at 1,800° C. with a tensile stress being applied to the fiber, was irradiated with an X-ray from a direction perpendicular to the fiber axis.

The present inventors made an extensive study from various angles in order to achieve the above objects. As a result, the inventors found a boron nitride fiber comprising hexagonal, rhombohedral and/or turbostratic boron nitride having C planes predominantly oriented to a direction parallel to the fiber axis, and further found for the first time that as the orientation of the boron nitride fiber becomes higher, the tensile strength of the fiber increases remarkably. The present invention has been completed based on the finding.

The present invention relates to a boron nitride fiber as well as to a process for production of the fiber.

That is, the present invention resides in a boron nitride fiber comprising boron nitride having a multi-layered structure consisting of planes (C planes) each formed by linkage of 6-membered rings in the plane, in which boron and nitrogen are positioned alternately and bonded to each other, which fiber has a tensile strength of at least 1,400 MPa.

The present invention resides also in a boron nitride fiber comprising boron nitride having a multi-layered structure consisting of planes (C planes) each formed by linkage of 6-membered rings in the plane, in which boron and nitrogen are positioned alternately and bonded to each other, in which fiber at least part of each C plane is oriented substantially parallel to the fiber axis and the degree of orientation of each C plane is at least 0.74.

Further, the present invention resides in a process for producing a boron nitride fiber, which comprises:

(a) reacting a boron trihalide-nitrile compound adduct with an ammonium halide or a primary amine hydrohalide in the presence of a boron trihalide to form a boron nitride precursor, (b) dissolving the boron nitride precursor in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

Further, the present invention resides also in a process for producing a boron nitride fiber, which comprises:

(a) reacting a boron trihalide-nitrile compound adduct with an ammonium halide or a primary amine hydrohalide in the presence of a boron trihalide to form a boron nitride precursor, (b) dissolving the boron nitride precursor and an acrylonitrile polymer in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

The above boron nitride fiber and process for production of the fiber, according to the present invention are hereinafter described in detail.

Boron nitride is a substance formed by the chemical bonding of boron of the group III of periodic table and nitrogen of group V of the periodic table. The following two kinds of boron nitrides are known currently:

(1) boron nitride having a structure in which boron and nitrogen are bonded to each other three-dimensionally, and (2) boron nitride having a structure in which boron and nitrogen are bonded to each other two-dimensionally.

As the boron nitride having a structure in which boron and nitrogen are bonded to each other two-dimensionally, there is known boron nitride having a multi-layered structure consisting of planes each formed by linkage of 6-membered rings in the plane in which boron and nitrogen are positioned alternately and bonded to each other.

As the boron nitride having a multi-layered structure consisting of the above-mentioned planes, the following three boron nitrides are known:

(a) hexagonal boron nitride (h-BN) having a multi-layered structure consisting of two-layered structural units, (b) rhombohedral boron nitride (r-BN) having a multi-layered structure consisting of three-layered structural units, and (c) turbostratic boron nitride (t-BN) having a multi-layered structure wherein layers (planes) are not piled up regularly.

The boron nitride fiber of the present invention comprises the above-mentioned boron nitride having a multi-layered structure consisting of planes each formed by linkage of 6-membered rings in the plane in which boron and nitrogen are positioned alternately and bonded to each other.

The boron nitride according to the present invention, therefore, may comprise hexagonal boron nitride (h-BN), rhombohedral boron nitride (r-BN) and/or turbostratic boron nitride (t-BN).

Generally in the present invention, however, hexagonal boron nitride (h-BN) and/or turbostratic boron nitride (t-BN) constitutes the major part of the whole boron nitride in many cases and the proportion of rhombohedral boron nitride (r-BN), even if it is present, is small in many cases.

The hexagonal structure and rhombohedral structure have a structure in which the planes formed by two-dimensional linkage of 6-membered rings in which boron and nitrogen are positioned alternately and bonded to each other (the planes are hereinafter referred to as "C planes" in some cases), are piled up regularly. The turbostratic structure is a structure in which the C planes are piled up without having any regularity in a direction perpendicular to the planes, and is called a structure consisting of randomly piled layers, in some cases.

Hexagonal boron nitride and turbostratic boron nitride can each be confirmed from the peak of diffraction from the (002) plane when subjected to X-ray diffractometry. The two crystal structures can be distinguished by examining, by X-ray diffractometry, a peak of diffraction from the crystal planes of boron nitride perpendicular to the C planes, for example, a peak of diffraction from the (110) plane. However, detection of such a diffraction peak [e.g. (110)

peak] to distinguish the hexagonal structure and the turbostratic structure is difficult, in some cases, when the crystallite size of boron nitride is very small as in the case of the boron nitride constituting the boron nitride fiber of the present invention, because the diffraction peak obtained by powder X-ray diffractometry has a very large width. Therefore, the boron nitride fiber of the present invention contains at least either of hexagonal boron nitride and turbostratic boron nitride, and is a mixture of hexagonal boron nitride and turbostratic boron nitride in some cases.

In the boron nitride fiber of the present invention, the crystallite size of the hexagonal boron nitride and turbostratic boron nitride constituting the fiber is very small, in the range of 10–60 Å.

The crystallite size represents the size of the hexagonal and/or turbostratic boron nitride constituting the boron nitride fiber, in a direction in which the C planes are piled up. Since in the hexagonal and/or turbostratic boron nitride the distance between two adjacent C planes is about 3.3 Å, crystallite size of 10–60 Å indicate that the boron nitride has a multi-layered structure consisting of 3–20 C planes and that such a boron nitride constitutes the boron nitride fiber of the present invention.

The boron nitride fiber of the present invention exhibits substantially no increase in crystallite size even when exposed to high temperatures. It is generally known that hexagonal boron nitride, when containing boron oxide as an impurity, exhibits an increase in crystallite size when heated at high temperatures. In the present invention, a boron nitride fiber having very small crystallite size is obtained, and the reason therefor is presumed to be that no oxygen is contained in the starting materials or introduced during the production process and consequently a boron nitride fiber can be produced which contains no boron oxide.

In the boron nitride fiber of the present invention, the most important matter is that the C planes of the hexagonal or turbostratic boron nitride constituting the fiber are predominantly oriented in a direction parallel to the fiber axis.

In the boron nitride fibers obtained heretofore, the C planes of the hexagonal or turbostratic boron nitride constituting each fiber are distributed isotropically to the fiber axis. Meanwhile, the present inventors found a boron nitride fiber in which the C planes of the hexagonal or turbostratic boron nitride constituting the fiber are oriented parallel to the fiber axis. The present inventors further found for the first time that an increase in degree of this orientation gives a boron nitride fiber having an increased tensile strength. The inventors are unable to make clear explanation of the reason why the orientation of the C planes of hexagonal or turbostratic boron nitride, parallel to fiber axis gives a boron nitride fiber having an increased tensile strength. However, the reason is presumed to be as follows.

In hexagonal or turbostratic boron nitride, the bond within each C plane is presumed to be mainly a covalent bond which is strong, and the bond between C planes is presumed to be mainly a bond by van der Waals force which is weak. Hence, it is presumed that an increase in the proportion of the strong bond within each C plane parallel the fiber axis gives an increased tensile strength. When the C planes of hexagonal or turbostratic boron nitride constituting a boron nitride fiber are oriented isotropically to the fiber axis, it is presumed that the tensile strength of the boron nitride fiber is suppressed by the presence of boron nitride whose C planes are perpendicular to the fiber axis, making it difficult to obtain a boron nitride fiber having a high tensile strength. This presumption is supported by the fact that a higher orientation of C planes of hexagonal or turbostratic boron nitride in a direction parallel to the fiber axis gives a higher strength.

In the past researches on boron nitride fibers, attention was paid only to the production of fibrous boron nitride and no attention was paid to the crystal orientation of boron nitride or to the effect of crystal orientation on properties (e.g. tensile strength) of boron nitride.

In expressing the distribution of the orientation of C planes of hexagonal or turbostratic boron nitride of boron nitride fiber to the fiber axis, degree of orientation of C planes (hereinafter referred to as "degree of orientation", in some cases) is used as the yardstick of the orientation distribution. The boron nitride fiber of the present invention has, as its feature, a degree of orientation of 0.74 or above. The present inventors also found a boron nitride fiber having a degree of orientation of less than 0.74 and it is possible to produce such a boron nitride fiber. Boron nitride fibers of various degrees of orientation were produced and the relation between the tensile strength and the degree of orientation, of these boron nitride fibers were systematically examined. As a result, a boron nitride fiber having a degree of orientation of less than 0.5 has substantially the same tensile strength as that of a boron nitride fiber whose C planes are not predominantly oriented in a direction parallel to the fiber axis. In contrast, a boron nitride fiber having a degree of orientation of 0.5 or above has a tensile strength significantly higher than that of a non-oriented boron nitride fiber. For example, both of boron nitride fibers having degrees of orientation of 0.26 and 0.46 had a tensile strength of 440 MPa, while a boron nitride fiber having a degree of orientation of 0.80 had a tensile strength of 1,970 MPa.

In boron nitride fibers having degrees of orientation of 0.7 or above, the tensile strength of fiber increases substantially in proportion to the degree of orientation of fiber under the same given condition. For example, a fiber having a degree of orientation of 0.70 had a tensile strength of 840 MPa, while a fiber having a degree of orientation of 0.78 had an increased tensile strength of 1,400 MPa. Thus, in a fiber having a degree of orientation of 0.70 or above, the tensile strength can be further increased by increasing the degree of orientation.

The boron nitride fiber of the present invention has a tensile strength of at least 1,400 MPa, preferably at least 1,660 MPa, more preferably at least 1,870 MPa, further preferably at least 1,890 MPa, furthermore preferably at least 1,910 MPa, particularly preferably at least 1,970 MPa, most preferably at least 2,300 MPa.

The above tensile strength can be measured in accordance with "Testing Methods for Carbon Fibers" specified by JIS R 7601 (1986).

The boron nitride fiber of the present invention has a degree of orientation of at least 0.74, preferably at least 0.78, more preferably at least 0.80, further preferably at least 0.81, furthermore preferably at least 0.82, particularly preferably at least 0.83, most preferably at least 0.86.

An increase in a degree of orientation increases not only tensile strength but also thermal conductivity in fiber axis direction. In the case of graphite single crystal, it is known that the thermal conductivity in the direction parallel to the plane formed by linkage between six-carbon-membered rings is higher than that in the direction perpendicular to the plane. Also, in the case of a carbon fiber in which the six-carbon-membered rings are predominantly oriented to a direction parallel to the fiber axis, it is known that an increase in degree of orientation gives an increased thermal conductivity.

Meanwhile, in the case of boron nitride, it is known that when a boron nitride obtained by piling up the C planes of boron nitride regularly by chemical vapor phase method is measured for thermal conductivity, the thermal conductivity in the direction parallel to the C plane is about 100 times as high as that in the direction perpendicular to the C plane. Hence, it is thought that a boron nitride fiber of high degree of orientation, as compared with a boron nitride fiber of low degree of orientation, has a high thermal conductivity in the fiber axis direction. In general, boron nitride has a thermal conductivity about 10 times as high as those of alumina, mullite, silicon nitride, etc.; therefore, there are cases that the thermal conductivity of a material is increased by blending it with boron nitride to form a composite material. In such cases, the thermal conductivity of the composite material can be increased efficiently by the use of a boron nitride fiber with an improved degree of orientation because the fiber has an increased thermal conductivity in the direction of the fiber axis.

The above-mentioned degree of orientation can be measured, by X-ray diffractometry, based on the distribution of X-ray intensity on the Debye ring formed by X-ray diffraction from C planes of hexagonal or turbostratic boron nitride. The method for measurement of degree of orientation by X-ray diffractometry is described below.

Using, as an X-ray for diffractometry, a copper Kα ray monochromatised using a nickel filter (the copper Kα ray is hereinafter referred to as "Cu Kα ray"), diffraction intensity is measured by transmission method. The source for X-ray desirably has a circular cross section in order to obtain diffraction at a high efficiency from the X-ray output used.

A fiber bundle consisting of several tens to several hundreds of boron nitride fibers is fixed using, for example, a small amount of collodion, in such a manner that the boron nitride fibers are arranged as parallel as possible, and the resulting bundle is used as a sample to be subjected to X-ray diffraction. This sample is hereinafter referred to as "sample for X-ray diffraction".

The measurement of diffraction intensity can be conducted using any of a method of photographing a diffraction pattern and a method using an X-ray diffractometer.

In measurement of diffraction intensity by the method of photographing a diffraction pattern, a sample for X-ray diffraction is fixed so that the fiber axis of each boron nitride fiber of the sample for X-ray diffraction is in a plane perpendicular to an incident X-ray and that the X-ray can be applied, without fail, to the sample for X-ray diffraction, i.e. the boron nitride fibers bundle. At this time, the direction of the fiber axis of each fiber of the sample for X-ray diffraction, in a plane perpendicular to the incident X-ray may be any desired direction as long as its direction relative to the diffraction pattern formed can be known. Herein, however, the fiber axis is fixed vertically for explanation purpose.

An X-ray-sensitive film for photographing a diffraction pattern formed is placed at the side of the sample for X-ray diffraction, opposite to the sample side to which an X-ray is applied. The X-ray-sensitive film is placed perpendicularly to the direction of the incident X-ray. The distance from the sample for X-ray diffraction to the X-ray-sensitive film (the distance is hereinafter referred to as "camera length" in some cases) must be such as to allow photographing of the whole portion of a Debye ring formed by the diffraction from the C planes of the hexagonal or turbostratic boron nitride constituting each boron nitride fiber of the sample for X-ray diffraction. The radius (D) of Debye ring on X-ray-sensitive film is determined from the following formula (1):

$$D=L\times\tan(2\theta) \quad (1)$$

(wherein L is a camera length; and 2θ is an angle of diffraction from the C planes of the hexagonal or turbostratic boron nitride constituting each boron nitride fiber of the sample for X-ray diffraction, which satisfies Bragg condition. In the case of the hexagonal or turbostratic boron nitride constituting each boron nitride fiber, 2θ is in the range of 24°–26° when the incident X-ray is a Cu Kα ray. Hence, the camera length L can be determined so that a circle of radius D having its center at an intersecting point of the direction of an incident X-ray and the X-ray-sensitive film, is contained in the X-ray-sensitive film.

Intensity of diffracted X-ray varies depending mainly upon the amount of boron nitride fiber in sample for X-ray diffraction, and upon the crystallite size of hexagonal or turbostratic boron nitride constituting the fiber, etc. Therefore, the exposure time of X-ray used must be controlled in order to obtain an optimum diffraction pattern. When the exposure time is too long, the blackening of X-ray-sensitive film by diffracted X-ray is not proportional to the intensity of diffracted X-ray; as a result, in the obtained distribution of intensity of diffracted X-ray, the portion of strong intensity is relatively weaker than actual, and no accurate degree of orientation can be obtained. When the exposure time is too short, the S/N ratio of blackening of X-ray-sensitive film by diffracted X-ray is small and the degree of orientation obtained has a large error. An appropriate exposure time can be determined by photographing various diffraction patterns of the same sample for X-ray diffraction in various exposure times and confirming that there is no change in the degree of orientations obtained.

By developing the X-ray-sensitive film after X-ray application, the X-ray-irradiated portion of the film blackens in proportion to the intensity of diffracted X-ray applied. Therefore, by measuring the blackening degree of the film using a microdensitometer, the intensity of diffracted X-ray applied can be determined. When the C planes of the hexagonal or boron nitride constituting each boron nitride fiber of the sample for X-ray diffraction are oriented parallel to the fiber axis direction of the boron nitride fiber, there appears, on the Debye ring formed on the X-ray-sensitive film, such a distribution of diffraction intensity that the blackening degree of the film is maximum in a direction passing the center of the Debye ring, i.e. an intersecting point between incident X-ray and X-ray-sensitive film and perpendicular to the fiber axis of each boron nitride fiber of the sample for X-ray diffraction (the direction is hereinafter referred to as "equator direction" in some cases) and that the blackening degree of the film is minimum in a direction passing the center of the Debye ring and parallel to the fiber axis of each boron nitride fiber of the sample for X-ray diffraction (the direction is hereinafter referred to as "meridian direction" in some cases). The position of each point on Debye ring to be measured for diffraction intensity is determined by a central angle φ measured from an arbitrarily selected base point on Debye ring, and the intensity of diffracted X-ray of each measurement point on Debye ring is determined as a function of the central angle φ. At this time, the intensity of diffracted X-ray on Debye ring is a sum of the intensity of X-ray diffracted from the C planes of each boron nitride fiber and the intensity of the background. Hence, in order to obtain a net intensity of X-ray diffracted from C planes, the change in X-ray intensity in the radial direction of Debye ring is measured to determine the background intensity on Debye ring and then the background intensity is subtracted from the intensity of diffracted X-ray on Debye ring. By determining the intensity of X-ray diffracted from C planes, as a function of central angle φ, there can be obtained two peaks at positions corresponding to the equator direction. The full width at half maximum (unit=degree) is measured for the each peak and the average (H) of the two widths is calculated. Using this H, degree of orientation ($\pi$) of crystal can be calculated from the following formula (2) ["Development and Evaluation of Carbon Fibers", p. 118 (1989), compiled by The Carbon Society of Japan].

$$\pi=(180-H)/180 \quad (2)$$

Diffraction intensity can also be measured by the use of an X-ray diffractometer. The diffractometer may be a known diffractometer, but description is hereinafter made on a diffractometer in which the diffractometer axis is vertical and the scanning plane of a detector is horizontal. When an X-ray diffractometer is used, a fiber sample holder is used which can fix a sample for X-ray diffraction and which has a mechanism capable of rotating the sample in the range of 360° in a plane perpendicular to an X-ray applied.

First, there is determined, by transmission method, an angle of diffraction at which the C planes of the hexagonal or turbostratic boron nitride constituting each boron nitride fiber of a sample for X-ray diffraction satisfy Bragg condition. The sample for X-ray diffraction is fixed to the fiber sample holder, and the fiber axis of each boron nitride fiber of the sample is fixed perpendicularly. In this state, an X-ray is applied to the sample and the detector, i.e the $2\theta$ of the diffractometer is scanned to measure the intensity of diffracted X-ray. Since the diffraction from the C planes of hexagonal or turbostratic boron nitride takes place generally at $2\theta=24°$ to 26°, there is measured, in this angle range, an angle at which the intensity of diffracted X-ray becomes maximum. This angle is taken as "diffraction angle of C planes". Next, the detector is fixed to the diffraction angle of C planes; an X-ray is applied; and the sample for X-ray diffraction fixed to the fiber sample holder is rotated in the range of 360° in a plane perpendicular to the X-ray applied, to measure the intensities of diffracted X-ray. Now, the rotational angle of the sample for X-ray diffraction is taken as $\alpha$ (unit: degree); and a state in which the fiber axis of each boron nitride fiber of the sample is vertical, is taken as $\alpha=0°$. When the C planes of the hexagonal or turbostratic boron nitride constituting each boron nitride fiber of the sample are oriented in a direction of the fiber axis of each boron nitride fiber, the diffracted X-ray gives two intensity peaks at $\alpha=0°$ and $\alpha=180°$. At this time, a net intensity of diffracted X-ray must be obtained by subtracting the intensity of background in the same manner as in the above-mentioned case of photographing a diffraction pattern. The full widths at half maximum (unit: degree) are measured for the two peaks and, using the average (H) of the widths obtained, a degree of orientation ($\pi$) can be calculated from the formula (2).

There is no particular restriction for production of the boron nitride fiber of the present invention having a large tensile strength and C planes of high degree of orientation. However, the present boron nitride fiber can be typically produced as follows.

(a) First, a boron trihalide-nitrile compound adduct is reacted with an ammonium halide or a primary amine hydrohalide in the presence of a boron trihalide to form a boron nitride precursor.

The boron trihalide includes boron trifluoride, boron trichloride, boron tribromide, boron triiodide, etc. They can be used with no particular restriction.

As the nitrile compound, a known compound having a nitrile group can be used with no particular restriction. Specific examples of the nitrile compound are acetonitrile, propionitrile, capronitrile, acrylonitrile, crotononitrile, tolunitrile, benzonitrile, isobutyronitrile, n-butyronitrile, isovaleronitrile, 2-methylbutyronitrile, pivalonitrile, n-valeronitrile, malononitrile, succinonitrile, glutaronitrile, adiponitrile, pimelonitrile and suberonitrile. As the number of carbon atoms of the nitrile compound increases, the amount of carbon in the resulting boron nitride precursor increases and the amount of carbon to be eliminated becomes large in order to convert the boron nitride precursor to boron nitride by heat treatment. Therefore, use of a nitrile compound having a less amount of carbon atoms, such as acetonitrile, acrylonitrile or the like is preferred.

The ammonium halide includes ammonium fluoride, ammonium chloride, ammonium bromide, ammonium iodide, etc. A preferable example of the ammonium halide is ammonium chloride.

The primary amine hydrohalide includes a primary amine hydrofluoride, a primary amine hydrochloride, a primary amine hydrobromide, a primary amine hydroiodide, etc. A preferable example of the primary amine hydrohalide is a primary amine hydrochloride.

The primary amine hydrochloride is represented by a general formula $RNH_2$ .HCl, and there can be used, with no restriction, a compound wherein R is an alkyl group such as methyl, ethyl, propyl or the like, or an aryl group such as phenyl, tolyl, xylyl or the like. However, use of a primary amine hydrochloride wherein R is a lower alkyl group such as methyl, ethyl or the like, is preferred because as the number of carbon atoms of R increases, the amount of carbon in the resulting boron nitride precursor increases and the amount of carbon eliminated becomes large in order to convert the boron nitride precursor to boron nitride by heat treatment.

In order to obtain the boron nitride fiber of the present invention, first, an adduct between the above-mentioned boron halide and nitrile compound is reacted with the above-mentioned ammonium halide or primary amine hydrohalide to form a boron nitride precursor.

The adduct between the boron trihalide and the nitrile compound is a product wherein the boron of boron trihydride is bonded, by an addition reaction, to the non-bonded electron pair of the nitrogen atom of the nitrile group. The boron trihalide and the nitrile compound react with each other easily to form the adduct. There is no particular restriction as to the method for forming the adduct. The adduct can be formed, for example, by a method which comprises dissolving a nitrile compound in an organic solvent and adding a boron trihalide dropwise to the solution at room temperature, a method which comprises dissolving a nitrile compound in an organic solvent and introducing a gaseous boron trihalide into the solution by bubbling, or a method which comprises dissolving a boron trihalide in an organic solvent and adding a nitrile compound dropwise to the solution. Since the boron trihalide and the nitrile compound react with each other easily to form an adduct, the two materials may be contacted right before the reaction.

At the time when the adduct is reacted with the ammonium halide or the primary amine hydrohalide, presence of a boron trihalide is essential. When no boron trihalide is present during the above reaction, the yield of the boron nitride precursor is low and a by-product is formed which is insoluble in the solvent used in spinning (mentioned later), for example, N,N-dimethylformamide (hereinafter referred to as DMF, in some cases).

It is sufficient that the boron trihalide is present at least during the reaction of the boron trihalide-nitrile compound adduct with the ammonium halide or the primary amine hydrohalide. For example, by using the boron trihalide in excess in forming the boron trihalide-nitrile compound adduct, unreacted boron trihalide and the adduct may be allowed to coexist. The amount of the boron trihalide used relative to the nitrile compound can be selected as desired in the range of 1.05–2.00 in terms of boron trihalide/nitrile compound molar ratio. However, since too small an amount of the boron trihalide invites formation of DMF-insoluble compound and too large an amount of the boron trihalide gives an increased amount of the boron trihalide not contributing to the reaction, the boron trihalide/nitrile compound molar ratio is preferably 1.1–1.5. Since the boron trihalide and the nitrile compound form an adduct at a 1:1 molar ratio, the amount of the boron trihalide present during the reaction of the adduct with the ammonium halide or the primary amine hydrohalide is 0.1–0.5 in terms of boron trihalide/adduct molar ratio.

There is no particular restriction as to the concentration of the nitrile compound in the reaction solvent. The concentration, however, is preferably in the range of 0.1–10 mole/l. When the concentration of the nitrile compound is less than 0.1 mole/l, the amount of the resulting boron nitride precursor is small, which is inefficient and not desirable. When the concentration of the nitrile compound is more than 10 mole/l, the amount of the solid adduct formed is too large relative to the amount of the solvent and the homogeneous formation of the adduct is prevented, which is not desirable.

The amount of the ammonium halide or primary amine hydrohalide added is preferably selected in the range of 0.67–1.5 in terms of ammonium halide or primary amine hydrohalide/nitrile compound molar ratio. When the amount of the ammonium halide or primary amine hydrohalide is too large, a DMF-insoluble compound is formed. When the amount of the nitrile compound is too large, the amount of unreacted adduct tends to increase. Therefore, selection of the above molar ratio in the range of 0.83–1.2 is more preferable.

There is no particular restriction as to the solvent used for synthesis of the boron nitride precursor of the present invention. However, it is preferable that the solvent can easily dissolve and remove the reaction by-products such as borazine compound and the like in separating the reaction product, i.e. the boron nitride precursor. From this standpoint, there is preferably selected an organic solvent such as benzene, toluene, xylene, chlorobenzene or the like.

The reaction temperature employed for reacting the adduct with the ammonium halide or the primary amine hydrohalide is preferably selected in the range of 100°–160° C. because, in general, use of a low temperature requires a long reaction time and use of a high temperature produces an increased amount of by-products insoluble in DMF and gives a reduced yield. The reaction time is preferably selected in the range of 3–30 hours although it varies depending upon the reaction temperature employed.

The above heating treatment produces a boron nitride precursor in the form of an orange-colored or brown precipitate.

As the reactor for obtaining the boron nitride precursor, a known reactor is used with no particular restriction. However, since both the boron trihalide-nitrile compound adduct and the boron nitride precursor undergo hydrolysis, it is necessary that the reaction system inside is beforehand dried thoroughly with nitrogen gas or the like and that a moisture-absorbing agent such as calcium chloride or the like is provided at the open part of the reactor to prevent the incoming of moisture in air from outside the reaction system during the reaction.

(b) The boron nitride precursor produced in the above step (a) is dissolved in a solvent to prepare a boron nitride precursor solution.

The boron nitride precursor solution can be used as a spinning solution in the next step (c).

For preparing the boron nitride precursor fiber from the boron nitride precursor, a known method can be used with no particular restriction. For example, when the boron nitride precursor solution is spun to obtain a precursor fiber, the boron nitride precursor is dissolved in a precursor-soluble solvent to prepare a spinning solution. The precursor-soluble solvent includes, for example, DMF, ε-caprolactam, crotononitrile, malonitrile, N-methyl-β-cyanoethylformamide and N,N-diethylformamide. By dissolving the boron nitride precursor in the precursor-soluble solvent, an orange-colored or brown transparent spinning solution is obtained.

The viscosity of the spinning solution can as necessary be controlled, for example, by the addition of an acrylonitrile polymer. When the boron nitride precursor has a relatively small molecular weight, an acrylonitrile polymer having a relatively large molecular weight is used together with the precursor, whereby the resulting spinning solution can have a higher viscosity and improved spinnability.

There is no particular restriction as to the acrylonitrile polymer used in the present invention, as long as the polymer is soluble in the solvent constituting the spinning solution and causes no phase separation from the boron nitride precursor in the spinning solution. The acrylonitrile polymer is preferably a polymer of acrylonitrile or a copolymer of acrylonitrile and a vinyl group-containing polymerizable monomer other than acrylonitrile (the monomer is hereinafter referred to simply as "vinyl monomer"), such as vinyl acetate, acrylamide, methacrylic acid, methacrylic acid ester, acrylic acid, acrylic acid ester or the like. When an acrylonitrile/vinyl monomer copolymer is used, the proportion of acrylonitrile in the copolymer is preferably 85 mole % or more based on the total polymerizable monomers because an increase in amount of vinyl monomer in the copolymer tends to cause phase separation of the copolymer from the boron nitride precursor in the spinning solution. The vinyl monomer contains an oxygen atom(s), and the oxygen atom(s) may show adverse effects on the boron nitride fiber obtained, for example, growth of boron nitride crystals and consequent reduction in strength of boron nitride fiber. The acrylonitrile polymer, therefore, is more preferably an acrylonitrile homopolymer.

The weight-average molecular weight of the acrylonitrile polymer used in the present invention is not particularly restricted, but is preferably in the range of 10,000 to 2,000,000.

The amount of the acrylonitrile polymer added to the spinning solution is not particularly restricted, but is preferably 0.01–5 parts by weight per 100 parts by weight of the boron nitride precursor.

(c) The boron nitride precursor solution prepared in the step (b) is spun to form a boron nitride precursor fiber.

The preferable concentration range of the spinning solution is 0.01–3.0 g/ml although it varies depending upon the spinning method employed, and the viscosity employed during spinning is 10–100,000 poises. For spinning a boron nitride precursor fiber from the spinning solution, a well known method can be used. A boron nitride precursor fiber can be spun, for example, by a method of rotating a small-hole-provided vessel containing a spinning solution, to extrude the spinning solution from the hole by the utilization of a centrifugal force; a method of extruding a spinning solution from a small hole by the utilization of a gas pressure; or a method of extruding a spinning solution from a small hole by the utilization of a gear pump.

The spinning temperature is, for example, −60° to 200° C., preferably −10° to 180° C., more preferably 0° to 160° C. although it varies depending upon the solvent used.

(d) The boron nitride precursor fiber is preheated at 100°–600° C. in an inert gas atmosphere.

(e) The preheated fiber is ammonia-treated at 200°–1,300° C. in an ammonia gas atmosphere.

That is, the boron nitride precursor fiber obtained in the step (c) is heat-treated (preheated) at 100°–600° C. in an inert gas atmosphere, and then heat-treated at 200°–1,300° C. in an ammonia gas atmosphere to obtain a boron nitride fiber. The boron nitride fiber at this state is hereinafter called "non-oriented boron nitride fiber". In producing the non-oriented boron nitride fiber, when only the heat treatment in an inert gas atmosphere is conducted, it is impossible to remove the carbon derived from the boron nitride precursor and the resulting fiber is black. When only the heat treatment in an ammonia gas atmosphere is conducted, the boron nitride crystallite of the resulting boron nitride fiber becomes coarse and the fiber surface has flaws and scars, making it impossible to obtain a boron nitride fiber of high strength.

As the atmosphere gas used in the heat treatment conducted in an inert gas atmosphere, there can be used nitrogen, argon, helium, etc. The temperature used in the heat treatment in an inert gas atmosphere can be selected as desired in the range of 100°–600° C., preferably 150°–550° C., more preferably 160°–500° C. When the heat treatment in an inert gas atmosphere is conducted at a temperature lower than 100° C., in the subsequent heat treatment conducted in an ammonia gas atmosphere, the boron nitride crystallite becomes coarse, the surface of the resulting fiber has flaws and scars, and the fiber has a reduced strength in some cases. When the heat treatment in an inert gas atmosphere is conducted at a temperature higher than 600° C., the carbon derived from the precursor is easily graphitized and it is difficult to remove the graphite in the subsequent heat treatment in an ammonia gas atmosphere.

The heating apparatus used for conducting the heat treatment of the boron nitride precursor fiber in an inert gas atmosphere may be an apparatus having a structure capable of controlling the inside atmosphere by a chamber, a tube or the like. A known heating apparatus such as electric furnace, gas furnace or the like can be used with no particular restriction.

As the method for heat treatment, there are a batch-wise method of heat-treating a certain amount of a boron nitride precursor fiber at once; and a continuous method of feeding a continuous boron nitride precursor fiber continuously into a heating apparatus beforehand heated to a heat treatment temperature, to conduct a heat treatment and winding up the heat-treated fiber. Any of these heat treatment methods may be used in the present invention. When a batch-wise heat treatment is conducted in an inert gas atmosphere, it can be conducted by introducing a boron nitride precursor fiber into a heating apparatus beforehand heated to a heat treatment temperature, or by arranging a boron nitride precursor fiber in a heating apparatus and then heating the fiber to a heat treatment temperature.

In any of the above heat treatment methods, when the boron nitride precursor fiber is heated rapidly, the solvent (e.g. DMF) used in preparation of the spinning solution from the boron nitride precursor vaporizes rapidly or the separation of thermal decomposition products takes place rapidly, and the resulting boron nitride fiber has flaws such as voids, cracks and the like and has a reduced strength in some cases. It is therefore preferable that the heat treatment in an inert gas atmosphere is conducted by employing a temperature elevation rate of 20° C./min or less up to the moment when the boron nitride precursor fiber reaches the heat treatment temperature. The retention time at the heat treatment temperature can be selected as desired in the range of 0–10 hours. A retention time of 0 hour indicates that the heat treatment is terminated immediately after the boron nitride precursor fiber has reached the heat treatment temperature, for example, by cooling the heating apparatus or by taking the boron nitride precursor fiber out of the heating apparatus.

The atmosphere used in the heat treatment in an inert gas atmosphere is preferably an inert gas atmosphere in any of the temperature elevation step in which the boron nitride precursor fiber reaches the heat treatment temperature, the retention step in which the precursor fiber is retained at the heat treatment temperature, and the cooling step up to the completion of the heat treatment, that is, while the boron nitride precursor fiber is in the chamber, tube or the like of the heating apparatus containing the inert gas atmosphere. The inert gas atmosphere can be obtained by purging the chamber, tube or the like of the heating apparatus with an inert gas and then sealing the heating apparatus, or by passing an inert gas through the chamber, tube or the like of the heating apparatus.

Following the heat treatment in an inert gas atmosphere, a heat treatment in an ammonia gas atmosphere is conducted. The temperature employed in the heat treatment in an ammonia gas atmosphere can be selected as desired in the range of 200°–1,300° C. When the heat treatment in an ammonia gas atmosphere is conducted at a temperature lower than 200° C., the carbon derived from the precursor cannot be removed sufficiently and 5–15% by weight of carbon remains in the resulting boron nitride fiber. Since the carbon derived from the precursor is decomposed and removed almost completely by a heat treatment at 200°–1,300° C., preferably at 250°–1,250° C., more preferably at 300°–1,200° C., it is not necessary to conduct the heat treatment in an ammonia gas atmosphere, at a temperature higher than 1,300° C.

The heating apparatus used for conducting the heat treatment of the boron nitride precursor fiber in an ammonia gas atmosphere may be an apparatus having a structure capable of controlling the inside atmosphere by a chamber, a tube or the like. A known heating apparatus such as electric furnace, gas furnace or the like can be used with no particular restriction. The method used for conducting the heat treatment may be any of a batch-wise method and a continuous method as in the case of the heat treatment in an inert gas atmosphere. When a batch-wise heat treatment is conducted, it is conducted by introducing a boron nitride precursor fiber into a heating apparatus heated beforehand to a heat treatment temperature, or by arranging a boron nitride precursor fiber in a heating apparatus and then heating the fiber to a heat treatment temperature.

In any of the above heat treatment methods, when the boron nitride precursor fiber is heated rapidly, the separation of thermal decomposition products takes place rapidly and the resulting boron nitride fiber has flaws such as voids, cracks and the like and has a reduced strength in some cases. It is therefore preferable that the heat treatment is conducted by employing a temperature elevation rate of 20° C./min or less up to the moment when the boron nitride precursor fiber reaches the heat treatment temperature. The retention time at the heat treatment temperature can be selected as desired in the range of 0–10 hours although it varies depending upon the amount of the boron nitride precursor fiber to be heat-treated. A retention time of 0 hour indicates that the heat treatment is terminated immediately after the boron nitride precursor fiber has reached the heat treatment temperature, by cooling the heating apparatus or by taking the boron nitride precursor fiber out of the heating apparatus.

In the heat treatment in an ammonia gas atmosphere, an ammonia gas atmosphere must be used in the temperature elevation step from the temperature of heat treatment in an inert gas atmosphere to the temperature of heat treatment in an ammonia gas atmosphere, and in the retention step at the temperature of heat treatment in an ammonia gas atmosphere. In other heat treatment steps, i.e. the temperature elevation step up to the temperature of heat treatment in an inert gas atmosphere and the cooling step from the temperature of heat treatment in an ammonia gas atmosphere, it is possible to use any of an inert gas atmosphere (e.g. nitrogen, argon or helium) and an ammonia gas atmosphere. The ammonia gas atmosphere can be obtained by purging the chamber, tube or the like of the heating apparatus with an ammonia gas and then sealing the heating apparatus, or by passing an ammonia gas through the chamber, tube or the like of the heating apparatus.

In the present invention, it is preferable that first a heat treatment (preheating) is conducted in an inert gas atmosphere and then a heat treatment is conducted in an ammonia gas atmosphere. The heat treatment in an inert gas atmosphere and the heat treatment in an ammonia gas atmosphere in this order may be carried out by first conducting the heat treatment in an inert gas atmosphere and, when the heat treatment is over, switching the atmosphere gas to ammonia to successively conduct the heat treatment in an ammonia gas atmosphere, or by completing the heat treatment in an inert gas atmosphere by cooling the heating apparatus or by taking the resulting boron nitride fiber out of the heating apparatus, and then newly conducting the heat treatment in an ammonia gas atmosphere.

(f) The ammonia-treated fiber obtained in the step (e) is heated at 1,600°–2,300° C. in an inert gas atmosphere with a tensile stress being applied to the fiber, whereby a boron nitride fiber of the present invention is obtained.

That is, a boron nitride fiber having a degree of orientation of 0.74 or above can be obtained by heat-treating a non-oriented boron nitride fiber at 1,600°–2,300° C., preferably at 1,650°–2,250° C., more preferably at 1,700°–2,200° C. in an inert gas atmosphere with a tensile stress being applied to the fiber (the heat treatment is hereinafter referred to as "orientation treatment" in some cases).

There is no particular restriction for the atmosphere used in the orientation treatment as long as the boron nitride of the non-oriented boron nitride fiber undergoes no chemical change caused by oxidation, etc. The atmosphere gas used in the orientation treatment may therefore be an inert gas such as nitrogen, argon, helium or the like. The orientation treatment may also be conducted in vacuum.

The temperature used in the orientation treatment can be selected as desired in the range of 1,600°–2,300° C. When the temperature is lower than 1,600° C., orientation does not proceed sufficiently even with a tensile stress applied and the resulting degree of orientation does not reach 0.74 in some cases. When the temperature is 2,300° C. or higher, the decomposition of boron nitride begins; therefore, the orientation treatment at 2,300° C. or higher is not preferable.

The heating apparatus used for conducting the orientation treatment may be an apparatus having a structure capable of controlling the inside atmosphere by a chamber, a tube or the like. A known heating apparatus such as electric furnace, gas furnace or the like can be used with no particular restriction. As the method for orientation treatment, there are a batch-wise method of treating a certain amount of a non-oriented boron nitride fiber at once; and a continuous method of feeding a continuous non-oriented boron nitride fiber continuously into a heating apparatus heated beforehand to an orientation treatment temperature, to conduct an orientation treatment and winding up the oriented fiber. Any of these orientation treatment methods may be used in the present invention. When a batch-wise orientation treatment is conducted, it can be conducted by introducing a non-oriented boron nitride fiber into a heating apparatus heated beforehand to an orientation treatment temperature, or by arranging a non-oriented boron nitride fiber in a heating apparatus and then heating the fiber to an orientation treatment temperature.

In the orientation treatment, when the nonoriented boron nitride fiber is heated rapidly, the resulting boron nitride fiber has flaws caused by the thermal stress applied and has a reduced strength in some cases. It is therefore preferable that the orientation treatment is conducted by employing a temperature elevation rate of 100° C./min or less up to the moment when the non-oriented boron nitride fiber reaches the orientation treatment temperature. The retention time at the orientation treatment temperature can be selected as desired in the range of 0–10 hours although it varies depending upon the amount and orientation treatment temperature of the non-oriented boron nitride fiber to be subjected to an orientation treatment. A retention time of 0 hour indicates that the orientation treatment is terminated immediately after the non-oriented boron nitride fiber has reached the orientation treatment temperature, by cooling the heating apparatus or by taking the non-oriented boron nitride fiber out of the heating apparatus.

The atmosphere used in the orientation treatment is preferably an inert gas atmosphere or vacuum in any of the temperature elevation step in which the non-oriented boron nitride fiber reaches the orientation treatment temperature, the retention step in which the non-oriented fiber is retained at the orientation treatment temperature, and the cooling step up to the completion of the orientation treatment. The inert gas atmosphere can be obtained by purging the chamber, tube or the like of the heating apparatus with an inert gas and then sealing the heating apparatus, or by passing an inert gas through the chamber, tube or the like of the heating apparatus.

There is no particular restriction as to the method for applying a tensile stress to the non-oriented boron nitride fiber in the orientation treatment. For example, when the orientation treatment is conducted batch-wise, the application of tensile stress can be conducted by suspending a non-oriented boron nitride fiber vertically and adding a weight to the lower end of the fiber. Alternatively, when a non-oriented boron nitride fiber is heat-treated at 1,600°–2,300° C. in an inert gas with no tensile stress applied, the fiber causes shrinkage in the fiber axis direction depending upon the heat treatment temperature; therefore, when a non-oriented boron nitride fiber is wound round a frame made of a material (e.g. boron nitride) not reactive with the fiber and is heat-treated in that state at 1,600°–2,300° C. in an inert gas atmosphere, the thermal shrinkage of the non-oriented boron nitride fiber caused by the heat treatment is prevented by the presence of the frame, which is essentially the same as the heat treatment of the non-oriented boron nitride fiber under application of a tensile stress. When the orientation treatment is conducted continuously, the thermal shrinkage of a non-oriented boron nitride fiber in the heat treatment can be controlled by controlling the rate of feeding of the fiber to a heating apparatus and the winding-up rate of the fiber after the heat treatment; as a result, the heat treatment (orientation treatment) can be conducted with a tensile stress being applied.

The tensile stress applied to a non-oriented boron nitride fiber in the orientation treatment varies depending upon the temperature and time of the orientation treatment, but can be selected as desired in the range of 0.1–1,000 MPa when a stress is applied, for example, by using a weight. When the stress applied is smaller than 0.1 MPa, orientation takes place insufficiently and the resulting degree of orientation does not reach 0.74 in some cases. When the stress applied is larger than 1,000 MPa, the non-oriented fiber breaks in some cases. Meanwhile, when a tensile stress is applied to a non-oriented boron nitride fiber by restricting the thermal shrinkage of the fiber caused by the heat treatment, or, in the case of the continuous orientation treatment, controlling the rate of feeding of the fiber to a heating apparatus and the winding-up rate of the fiber after the heat treatment to restrict the thermal shrinkage of the fiber caused by the heat treatment, the elongation ratio can be selected in the range of, for example, 10–32%. Herein, the elongation ratio (E) is defined by the following formula (3):

$$E=100\times(L_s-L_f)/L_f \quad (3)$$

wherein $L_f$ represents a fiber length when a boron nitride fiber sample of unit length has been heat-treated at a temperature (T °C. ) without restricting the thermal shrinkage of the sample, in other words, without applying any tensile stress to the sample; and $L_s$ represents a fiber length when the same boron nitride fiber sample of unit length has been heat-treated at the same temperature (T °C. ) while restricting the thermal shrinkage of the sample.

When the elongation ratio is smaller than 10%, the tensile stress applied to the non-oriented boron nitride fiber is insufficient and the resulting degree of orientation does not reach 0.74 in some cases. When the elongation ratio is larger than 32%, the non-oriented boron nitride fiber breaks during the orientation treatment in some cases.

The oriented boron nitride fiber produced as above has features that the crystallite size of boron nitride constituting the fiber are very small and that the fiber is white and has luster.

For production of the boron nitride fiber of the present invention, there is, for example, a process which comprises reacting an adduct between boron trichloride and a nitrile compound having 3 or less carbon atoms with ammonium chloride in the presence of boron trichloride to form a boron nitride precursor, dissolving the precursor in N,N-dimethylformamide (a solvent), spinning the resulting solution to form a precursor fiber, heat-treating the precursor fiber at 100°–600° C. in an inert gas atmosphere and then at 600°–1,300° C. in an ammonia gas atmosphere to form a boron nitride fiber, and heat-treating the fiber at 1,600°–2,300° C. with a tensile stress being applied. This process is preferable because it produces a boron nitride fiber at a high yield, the amount of residual carbon in the boron nitride fiber is reduced to be negligible, and the process operation is easy.

Industrial Applicability

The present invention allows production of a boron nitride fiber composed mainly of hexagonal and/or turbostratic boron nitride having C planes oriented parallel to the fiber axis and a degree of orientation of 0.74 or above. As a result, a boron nitride fiber having a remarkably increased tensile strength can be produced, and it has become possible to produce a boron nitride fiber having not only the heat resistance, oxidation resistance, solid lubricity and low reactivity inherently possessed by boron nitride, but also a high strength. Accordingly, the boron nitride fiber of the present invention can be applied as an excellent reinforcing fiber used for improvement of the toughness of ceramic material or the like to obtain a composite material.

EXAMPLES

The present invention is hereinafter described in detail by way of Examples. However, the present invention is in no way restricted to these Examples.

The tensile strength of a fiber is greatly influenced by the degree of orientation of the C planes of the fiber, but tends to be affected by the flaws, scars, etc. of the fiber surface which vary depending upon the spinning method employed. In the present invention, therefore, the change in tensile strength brought about by the change in degree of orientation in various fibers produced under the same conditions has an important meaning.

In the Examples, the yield of each boron nitride fiber precursor was determined based on the amount of boron (B) in the boron trihalide used as a starting material.

Each boron nitride fiber obtained in Examples and Comparative Examples was identified by confirming that it showed an absorption of BN at around 1,380 $cm^{-1}$ and around 800 $cm^{-1}$ in IR absorption spectrum and that it showed the maximum signal at around 2θ=26° in powder X-ray diffractometry.

Example 1

In a three-necked flask having a capacity of 1 l, the center tube was provided with a stirrer; one of the side tubes was provided with a Dewar type cold finger to which a boron trichloride-containing cylinder was connected; and the remaining side tube was provided with an Allihn condenser. To the Allihn condenser was fitted a Dewar type cold finger, and a calcium chloride tube was fitted to the outlet of the cold finger. Through the resulting apparatus was passed dry nitrogen at a rate of 200 ml/min for 4 hours to dry the apparatus inside. In the apparatus were placed 16.4 g of acetonitrile and 300 ml of chlorobenzene which had been dried overnight with anhydrous sodium sulfate. The two cold fingers were filled with dry ice-acetone. Boron trichloride of 60 g was added dropwise for 2 hours from a cold finger fitted directly to the three-necked flask to the contents of the flask which were stirred with the stirrer. Thereby, a white boron trichloride-acetonitrile adduct was formed. After the completion of the dropwise addition of boron trichloride, the cold finger directly fitted to the three-necked flask was detached, and 21.5 g of ammonium chloride dried at 110° C. overnight was added. When the resulting suspension was heated at 125° C. for 8 hours, the generation of hydrogen chloride stopped substantially and a brown precipitate was formed. The precipitate was collected by filtration, washed with 100 ml of chlorobenzene, and dried under vacuum to obtain 24 g (yield: 83%) of a boron nitride precursor.

10 g of the boron nitride precursor was dissolved in 200 ml of N,N-dimethylformamide (DMF). 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 $kg/cm^2$, followed by winding-up, to obtain a continuous boron nitride precursor fiber having a diameter of about 20 μm. At this time, the spinning solution had a viscosity of $3.0\times10^4$ poises and the spinning speed was 1.8 m/min.

The boron nitride precursor fiber was subjected to temperature elevation from room temperature to 400° C. at a rate of 1° C./min in a nitrogen current, and then allowed to cool to room temperature, whereby a heat treatment was conducted. The resulting fiber was then subjected to temperature elevation from room temperature to 1,000° C. at a rate of 2° C./min in an ammonia gas atmosphere, then cooled to 500° C. at a rate of 5° C./min, and allowed to cool to room temperature, whereby a heat treatment was conducted. As a result, a non-oriented boron nitride fiber having a diameter of about 15 μm was obtained.

The non-oriented boron nitride fiber was wound up in a loop shape having a circumference of 122 mm and, with the shape being retained, put round a boron nitride-made frame having a circumference of 103 mm. The fiber put round the frame was subjected to temperature elevation from room temperature to 1,800° C. at a rate of 10° C./min in a nitrogen current, kept at 1,800° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 12.7%. The boron nitride fiber obtained had a degree of orientation of 0.78 and a tensile strength of 1,400 MPa.

An X-ray (Cu Kμ, 50 kV, 24 mA) was applied to the above boron nitride fiber from a direction perpendicular to the fiber axis. The resulting diffraction pattern was photographed. The photograph is shown in FIG. 1.

Figure 3:
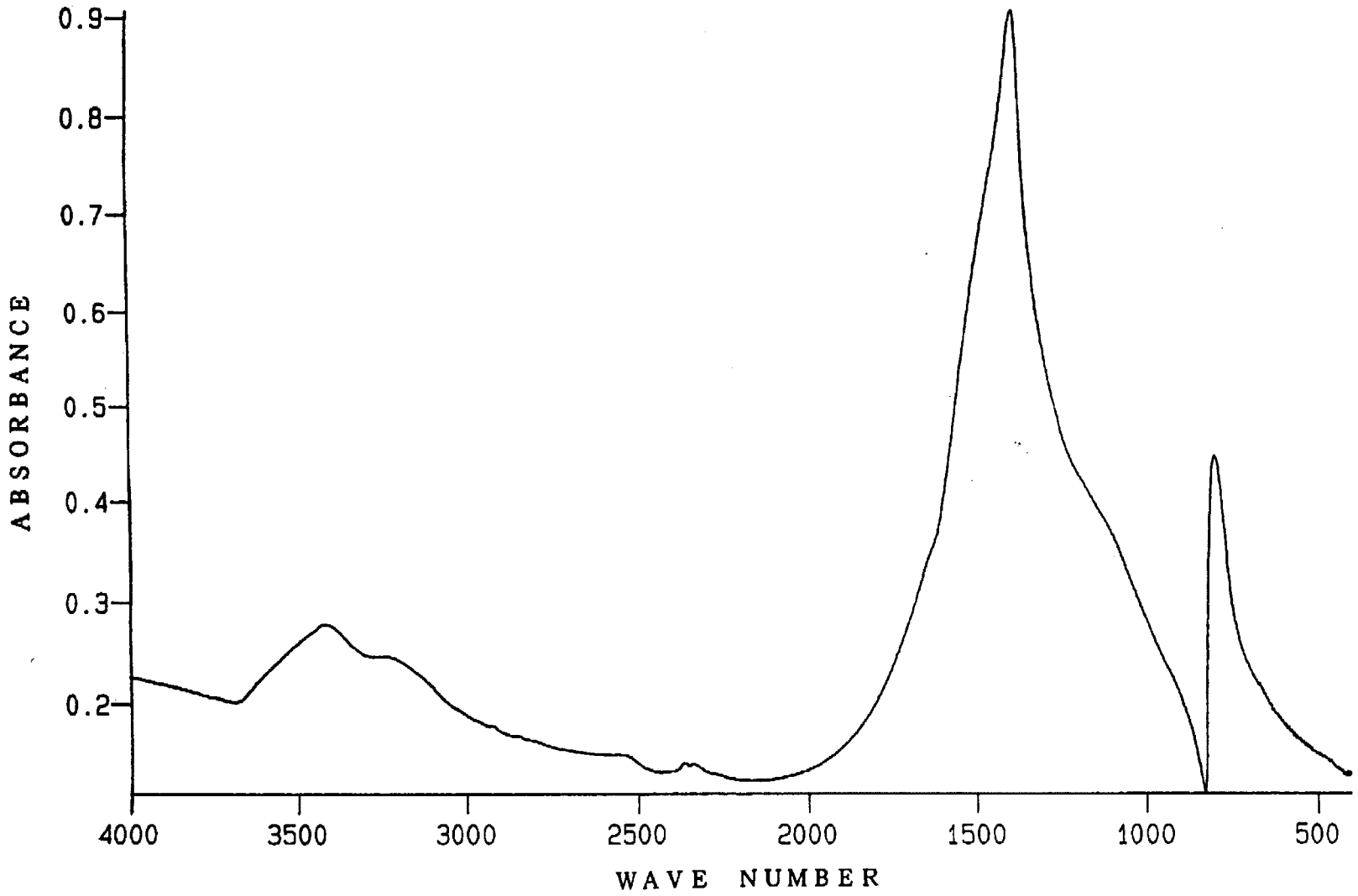
FIG. 3 shows an infrared absorption spectrum by KBr method, of a boron nitride fiber of the present invention.

The above boron nitride fiber was also measured for IR absorption spectrum (KBr). The spectrum is shown in FIG. 3.

Example 2

The non-oriented boron nitride fiber produced in the same manner as in Example 1 was wound up in a loop shape having a circumference of 122 mm and, with the shape being retained, put round a boron nitride-made frame having a circumference of 103 mm. The fiber put round the frame was subjected to temperature elevation from room temperature to 2,000° C. at a rate of 10° C./min in a nitrogen current, kept at 2,000° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 15.7%. The boron nitride fiber obtained had a degree of orientation of 0.74 and a tensile strength of 1,660 MPa.

Example 3

The non-oriented boron nitride fiber produced in the same manner as in Example 1 was wound up in a loop shape having a circumference of 122 mm and, with the shape being retained, put round a boron nitride-made frame having a circumference of 107 mm. The fiber put round the frame was subjected to temperature elevation from room temperature to 2,000° C. at a rate of 10° C./min in a nitrogen current, kept at 2,000° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 20.2%. The boron nitride fiber obtained had a degree of orientation of 0.80 and a tensile strength of 1,970 MPa.

Example 4

The non-oriented boron nitride fiber produced in the same manner as in Example 1 was wound up in a loop shape having a circumference of 122 mm and, with the shape being retained, put round a boron nitride-made frame having a circumference of 111 mm. The fiber put round the frame was subjected to temperature elevation from room temperature to 2,000° C. at a rate of 10° C./min in a nitrogen current, kept at 2,000° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 24.7%. The boron nitride fiber obtained had a degree of orientation of 0.86 and a tensile strength of 2,300 MPa.

Comparative Example 1

The non-oriented boron nitride fiber produced in the same manner as in Example 1 was wound up in a loop shape having a circumference of 122 mm and, with the shape being retained, put round a boron nitride-made frame having a circumference of 95 mm. The fiber put round the frame was subjected to temperature elevation from room temperature to 2,000° C. at a rate of 10° C./min in a nitrogen current, kept at 2,000° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 6.7%. The boron nitride fiber obtained had a degree of orientation of 0.66 and a tensile strength of 1,000 MPa.

Comparative Example 2

The non-oriented boron nitride fiber produced in the same manner as in Example 1 was wound up in a loop shape having a circumference of 122 mm and, with the shape being retained, put round a boron nitride-made frame having a circumference of 98 mm. The fiber put round the frame was subjected to temperature elevation from room temperature to 1,800° C. at a rate of 10° C./min in a nitrogen current, kept at 1,800° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 7.1%. The boron nitride fiber obtained had a degree of orientation of 0.70 and a tensile strength of 840 MPa.

Comparative Example 3

The non-oriented boron nitride fiber produced in the same manner as in Example 1 was wound up in a loop shape having a circumference of 122 mm and, with the shape being retained, put round a boron nitride-made frame having a circumference of 98 mm. The fiber put round the frame was subjected to temperature elevation from room temperature to 1,600° C. at a rate of 10° C./min in a nitrogen current, kept at 1,600° C. for 30 minutes, cooled to 500° C. at a rate of 5° C./min, and allowed to cool to room temperature, whereby an orientation treatment was conducted. The boron nitride fiber after the treatment neither broke nor got loose, and retained a state of being wound round the frame. The elongation ratio after the orientation treatment was 3.3%. The boron nitride fiber obtained had a degree of orientation of 0.46 and a tensile strength of 440 MPa.

Comparative Example 4

With no tensile stress applied, the non-oriented boron nitride fiber produced in the same manner as in Example 1 was subjected to temperature elevation from room temperature to 1,800° C. at a rate of 10° C./min in a nitrogen current, kept at 1,800° C. for 30 minutes, cooled to 500° C. at a rate of 5° C./min, and allowed to cool to room temperature, whereby an orientation treatment was conducted. The boron nitride fiber obtained had a degree of orientation of 0.35 and a tensile strength of 450 MPa.

Figure 2:
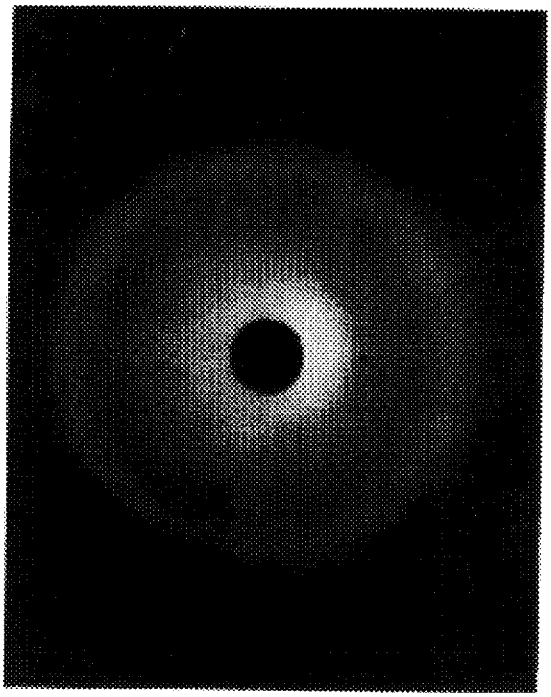
FIG. 2 is a photograph of a diffraction pattern obtained when a boron nitride fiber not falling in the present invention obtained by heating an ammonia-treated boron nitride fiber in a nitrogen gas atmosphere at 1,800° C. with no tensile stress being applied to the fiber, was irradiated with an X-ray from a direction perpendicular to the fiber axis.

An X-ray (Cu Kμ, 50 kV, 24 mA) was applied to the above boron nitride fiber from a direction perpendicular to the fiber axis. The resulting diffraction pattern was photographed. The photograph is shown in FIG. 2.

Comparative Example 5

With no tensile stress applied, the non-oriented boron nitride fiber produced in the same manner as in Example 1 was subjected to temperature elevation from room temperature to 1,600° C. at a rate of 10° C./min in a nitrogen current, kept at 1,600° C. for 30 minutes, cooled to 500 at a rate of 5° C./min, and allowed to cool to room temperature, whereby an orientation treatment was conducted. The boron nitride fiber obtained had a degree of orientation of 0.26 and a tensile strength of 440 MPa.

Comparative Example 6

With no tensile stress applied, the non-oriented boron nitride fiber produced in the same manner as in Example 1 was subjected to temperature elevation from room temperature to 2,000° C. at a rate of 10° C./min in a nitrogen current, kept at 2,000° C. for 30 minutes, cooled to 500° C. at a rate of 5° C./min, and allowed to cool to room temperature, whereby an orientation treatment was conducted. The boron nitride fiber obtained had a degree of orientation of 0.37 and a tensile strength of 470 MPa.

Example 5

The boron nitride precursor fiber produced in the same manner as in Example 1 was subjected to temperature elevation from room temperature to 400° C. at a rate of 1° C./min in a nitrogen current and then allowed to cool to room temperature, whereby a heat treatment was conducted. The resulting fiber was subjected to temperature elevation from room temperature to 400° C. at a rate of 2° C./min in an ammonia gas atmosphere and then allowed to cool to room temperature, whereby a heat treatment was conducted. Thereby, a non-oriented boron nitride fiber was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.82 and a tensile strength of 1,930 MPa.

Example 6

The boron nitride precursor fiber produced in the same manner as in Example 1 was subjected to temperature elevation from room temperature to 400° C. at a rate of 1° C./min in a nitrogen current and then allowed to cool to room temperature, whereby a heat treatment was conducted. The resulting fiber was subjected to temperature elevation from room temperature to 800° C. at a rate of 2° C./min in an ammonia gas atmosphere, then cooled to 500° C. at a rate of 5° C./min, and allowed to cool to room temperature, whereby a heat treatment was conducted. Thereby, a non-oriented boron nitride fiber was obtained.

The non-oriented boron nitride fiber was subjected to an orientation treatment in the same manner as in Example 3. The elongation ratio after the orientation treatment was 20.3%. The boron nitride fiber obtained had a degree of orientation of 0.83 and a tensile strength of 1,910 MPa.

Example 7

The boron nitride precursor fiber produced in the same manner as in Example 1 was subjected to temperature elevation from room temperature to 400° C. at a rate of 1° C./min in a nitrogen current and then allowed to cool to room temperature, whereby a heat treatment was conducted. The resulting fiber was subjected to temperature elevation from room temperature to 1,200° C. at a rate of 2° C./min in an ammonia gas atmosphere, then cooled to 500° C. at a rate of 5° C./min, and allowed to cool to room temperature, whereby a heat treatment was conducted. Thereby, a non-oriented boron nitride fiber was obtained.

The non-oriented boron nitride fiber was subjected to an orientation treatment in the same manner as in Example 3. The elongation ratio after the orientation treatment was 20.1%. The boron nitride fiber obtained had a degree of orientation of 0.82 and a tensile strength of 1,880 MPa.

Example 8

The boron nitride precursor fiber produced in the same manner as in Example 1 was subjected to temperature elevation from room temperature to 200° C. at a rate of 1° C./min in a nitrogen current and then allowed to cool to room temperature, whereby a heat treatment was conducted. The resulting fiber was subjected to temperature elevation from room temperature to 1,000° C. at a rate of 2° C./min in an ammonia gas atmosphere, then cooled to 500° C. at a rate of 5° C./min, and allowed to cool to room temperature, whereby a heat treatment was conducted. Thereby, a non-oriented boron nitride fiber was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.82 and a tensile strength of 1,890 MPa.

Example 9

In a three-necked flask having a capacity of 1 l, the center tube was provided with a stirrer; one of the side tubes was provided with a dropping funnel containing 128 g of boron tribromide; and the remaining side tube was provided with an Allihn condenser. To the outlet of the Allihn condenser was fitted a calcium chloride tube. Through the resulting apparatus was passed dry nitrogen at a rate of 200 ml/min for 4 hours to dry the apparatus inside. In the apparatus were placed 16.4 g of acetonitrile and 300 ml of chlorobenzene which had been dried overnight with anhydrous sodium sulfate. Into the apparatus contents being stirred with the stirrer was dropwise added, in 2 hours, boron tribromide from the dropping funnel. Thereby, a white boron tribromide-acetonitrile adduct was formed. After the completion of the dropwise addition of boron tribromide, the dropping funnel fitted to the three-necked flask was detached, and 21.5 g of ammonium chloride dried at 110° C. overnight was added. The resulting suspension was heated at 125° C. for 8 hours and then filtered. The precipitate collected was washed with 100 ml of chlorobenzene and dried under vacuum to obtain 48 g (yield: 80%) of a brown precipitate.

15 g of this boron nitride precursor was dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $2.8\times10^4$ poises and the spinning speed was 1.9 m/min.

The boron nitride precursor fiber obtained above was heat-treated in the same manner as in Example 1, at 400° C. in a nitrogen current and then at 1,000° C. in an ammonia gas atmosphere, whereby a non-oriented boron nitride fiber having a diameter of about 15 μm was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.81 and a tensile strength of 1,870 MPa.

Example 10

In a three-necked flask having a capacity of 1 l, the center tube was provided with a stirrer; one of the side tubes was provided with a dropping funnel containing 16.4 g of acetonitrile; and the remaining side tube was provided with an Allihn condenser. To the outlet of the Allihn condenser was fitted a calcium chloride tube. Through the resulting apparatus was passed dry nitrogen at a rate of 200 ml/min for 4 hours to dry the apparatus inside. In the apparatus were placed 200 g of boron triiodide and 300 ml of chlorobenzene which had been dried overnight with anhydrous sodium sulfate. Into the apparatus contents being stirred with the stirrer was dropwise added, in 2 hours, acetonitrile from the dropping funnel. Thereby, a white boron triiodide-acetonitrile adduct was formed. After the completion of the dropwise addition of boron triiodide, the dropping funnel fitted to the three-necked flask was detached, and 21.5 g of ammonium chloride dried at 110° C. overnight was added. The resulting suspension was heated at 125° C. for 8 hours and then filtered. The precipitate collected was washed with 100 ml of chlorobenzene and dried under vacuum to obtain 65 g (yield: 79%) of a brown precipitate.

20 g of this boron nitride precursor was dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $3.1\times10^4$ poises and the spinning speed was 1.7 m/min.

The boron nitride precursor fiber obtained above was heat-treated in the same manner as in Example 1, at 400° C. in a nitrogen current and then at 1,000° C. in an ammonia gas atmosphere, whereby a non-oriented boron nitride fiber having a diameter of about 15 μm was obtained.

The non-oriented boron nitride fiber was subjected to an orientation treatment in the same manner as in Example 3. The elongation ratio after the orientation treatment was 20.1%. The boron nitride fiber obtained had a degree of orientation of 0.81 and a tensile strength of 1,880 MPa.

Example 11

In a three-necked flask having a capacity of 1 l, the center tube was provided with a stirrer; one of the side tubes was provided with a Dewar type cold finger to which a boron trichloride-containing bomb was connected; and the remaining side tube was provided with an Allihn condenser. To the Allihn condenser was fitted a Dewar type cold finger, and a calcium chloride tube was fitted to the outlet of the cold finger. Through the resulting apparatus was passed dry nitrogen at a rate of 200 ml/min for 4 hours to dry the apparatus inside. In the apparatus were placed 16.4 g of acetonitrile and 300 ml of chlorobenzene which had been dried overnight with anhydrous sodium sulfate. The two cold fingers were filled with dry ice-acetone. Into the apparatus contents being stirred with the stirrer was dropwise added, in 2 hours, 60 g of condensed boron trichloride from a cold finger fitted directly to the three-necked flask. Thereby, a white boron trichloride-acetonitrile adduct was formed. After the completion of the dropwise addition of boron trichloride, the cold finger directly fitted to the three-necked flask was detached, and 27.2 g of monomethylamine hydrochloride dried at 110° C. overnight was added. When the resulting suspension was heated at 125° C. for 8 hours, the generation of hydrogen chloride stopped substantially and a brown precipitate was formed. The precipitate was collected by filtration, washed with 100 ml of chlorobenzene, and dried under vacuum to obtain 25 g (yield: 80%) of a boron nitride precursor.

10 g of the boron nitride precursor was dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $3.0\times10^4$ poises and the spinning speed was 1.7 m/min.

The boron nitride precursor fiber obtained above was heat-treated in the same manner as in Example 1, at 400° C. in a nitrogen current and then at 1,000° C. in an ammonia gas atmosphere, whereby a non-oriented boron nitride fiber having a diameter of about 15 μm was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.82 and a tensile strength of 1,900 MPa.

Example 12

In a three-necked flask having a capacity of 1 l, the center tube was provided with a stirrer; one of the side tubes was provided with a Dewar type cold finger to which a boron trichloride-containing bomb was connected; and the remaining side tube was provided with an Allihn condenser. To the Allihn condenser was fitted a Dewar type cold finger, and a calcium chloride tube was fitted to the outlet of the cold finger. Through the resulting apparatus was passed dry nitrogen at a rate of 200 ml/min for 4 hours to dry the apparatus inside. In the apparatus were placed 41.2 g of benzonitrile and 300 ml of chlorobenzene which had been dried overnight with anhydrous sodium sulfate. The two cold fingers were filled with dry ice-acetone. Into the apparatus contents being stirred with the stirrer was dropwise added, in 2 hours, 60 g of condensed boron trichloride from a cold finger fitted directly to the three-necked flask. Thereby, a white boron trichloride-benzonitrile adduct was formed. After the completion of the dropwise addition of boron trichloride, the cold finger directly fitted to the three-necked flask was detached, and 21.5 g of ammonium chloride dried at 110° C. overnight was added. When the resulting suspension was heated at 125° C. for 8 hours, the generation of hydrogen chloride stopped substantially and a brown precipitate was formed. The precipitate was collected by filtration, washed with 100 ml of chlorobenzene, and dried under vacuum to obtain 27 g (yield: 79%) of a boron nitride precursor.

10 g of the boron nitride precursor was dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $2.9\times10^4$ poises and the spinning speed was 1.8 m/min.

The boron nitride precursor fiber obtained above was heat-treated in the same manner as in Example 1, at 400° C. in a nitrogen current and then at 1,000° C. in an ammonia gas atmosphere, whereby a non-oriented boron nitride fiber having a diameter of about 15 μm was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.82 and a tensile strength of 1,910 MPa.

Example 13

In a three-necked flask having a capacity of 1 l, the center tube was provided with a stirrer; one of the side tubes was provided with a Dewar type cold finger to which a boron trichloride-containing bomb was connected; and the remaining side tube was provided with an Allihn condenser. To the Allihn condenser was fitted a Dewar type cold finger, and a calcium chloride tube was fitted to the outlet of the cold finger. Through the resulting apparatus was passed dry nitrogen at a rate of 200 ml/min for 4 hours to dry the apparatus inside. In the apparatus were placed 41.2 g of acrylonitrile and 300 ml of chlorobenzene which had been dried overnight with anhydrous sodium sulfate. The two cold fingers were filled with dry ice-acetone. Into the apparatus contents being stirred with the stirrer was dropwise added, in 2 hours, 60 g of condensed boron trichloride from a cold finger fitted directly to the three-necked flask. Thereby, a white boron trichloride-acrylonitrile adduct was formed. After the completion of the dropwise addition of boron trichloride, the cold finger directly fitted to the three-necked flask was detached, and 21.5 g of ammonium chloride dried at 110° C. overnight was added. When the resulting suspension was heated at 125° C. for 8 hours, the generation of hydrogen chloride stopped substantially and a brown precipitate was formed. The precipitate was collected by filtration, washed with 100 ml of chlorobenzene, and dried under vacuum to obtain 24 g (yield: 77%) of a boron nitride precursor.

10 g of the boron nitride precursor was dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $2.9\times10^4$ poises and the spinning speed was 1.8 m/min.

The boron nitride precursor fiber obtained above was heat-treated in the same manner as in Example 1, at 400° C. in a nitrogen current and then at 1,000° C. in an ammonia gas atmosphere, whereby a non-oriented boron nitride fiber having a diameter of about 15 μm was obtained.

The non-oriented boron nitride fiber was subjected to an orientation treatment in the same manner as in Example 3. The elongation ratio after the orientation treatment was 20.1%. The boron nitride fiber obtained had a degree of orientation of 0.81 and a tensile strength of 1,890 MPa.

Example 14

10 g of the boron nitride precursor produced in the same manner as in Example 1 and 0.05 g of a polyacrylonitrile having a weight-average molecular weight of 500,000 were dissolved in 200 ml of DMF. 100 ml of the DMF was removed from the resulting solution by vaporization, to obtain a uniform viscous solution. The solution was discharged into dry air at 25° C. from a spinning nozzle having holes of 60 μm in diameter, by applying a back pressure of 15 kg/cm$^2$, followed by winding-up, to obtain a continuous boron nitride precursor fiber having a diameter of about 20 μm. At this time, the spinning solution had a viscosity of $6\times10^1$ poises and the spinning speed was 18.0 m/min.

The boron nitride precursor fiber was subjected to temperature elevation from room temperature to 400° C. at a rate of 1° C./min in a nitrogen current, and then allowed to cool to room temperature, whereby a heat treatment was conducted. The resulting fiber was then subjected to temperature elevation from room temperature to 1,000° C. at a rate of 2° C./min in an ammonia gas atmosphere, then cooled to 500° C. at a rate of 5° C./min, and allowed to cool to room temperature, whereby a heat treatment was conducted. As a result, a non-oriented boron nitride fiber having a diameter of about 15 μm was obtained.

The non-oriented boron nitride fiber was subjected to an orientation treatment in the same manner as in Example 3. The elongation ratio after the orientation treatment was 20.2%. The boron nitride fiber obtained had a degree of orientation of 0.82 and a tensile strength of 1,900 MPa.

We claim:

1. A boron nitride fiber comprising boron nitride having a multi-layered structure consisting of planes (C planes) each formed by linkage of 6-membered rings in the plane, in which boron and nitrogen are positioned alternately and bonded to each other, which fiber has a tensile strength of at least 1,400 MPa.

2. A boron nitride fiber according to claim 1, having a tensile strength of at least 1,660 MPa.

3. A boron nitride fiber according to claim 1, having a tensile strength of at least 1,870 MPa.

4. A boron nitride fiber according to claim 1, having a tensile strength of at least 1,890 MPa.

5. A boron nitride fiber according to claim 1, having a tensile strength of at least 1,910 MPa.

6. A boron nitride fiber according to claim 1, having a tensile strength of at least 1,970 MPa.

7. A boron nitride fiber according to claim 1, having a tensile strength of at least 2,300 MPa.

8. A boron nitride fiber comprising boron nitride having a multi-layered structure consisting of planes (C planes) each formed by linkage of 6-membered rings in the plane, in which boron and nitrogen are positioned alternately and bonded to each other, which fiber has a degree of orientation of at least 0.74.

9. A boron nitride fiber according to claim 8, wherein the fiber has a degree of orientation of at least 0.78.

10. A boron nitride fiber according to claim 8, wherein the fiber has a degree of orientation of at least 0.80.

11. A boron nitride fiber according to claim 8, wherein the fiber has a degree of orientation of at least 0.81.

12. A boron nitride fiber according to claim 8, wherein the fiber has a degree of orientation of at least 0.82.

13. A boron nitride fiber according to claim 8, wherein the fiber has a degree of orientation of at least 0.83.

14. A boron nitride fiber according to claim 8, wherein the fiber has a degree of orientation of at least 0.86.

15. A process for producing a boron nitride fiber comprising boron nitride having a multi-layered structure consisting of planes (C planes) each formed by linkage of 6-membered rings in the plane, in which boron and nitrogen are positioned alternately and bonded to each other, which fiber has a tensile strength of at least 1,400 MPa, which process comprises:

(a) reacting a boron trihalide-nitrile compound adduct with an ammonium halide or a primary amine hydrohalide in the presence of a boron trihalide to form a boron nitride precursor, (b) dissolving the boron nitride precursor in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

16. A process for producing a boron nitride fiber according to claim 15, wherein in the step (a), the boron trihalide is boron trichloride, the nitrile compound is acetonitrile, and the ammonium halide or the primary amine hydrohalide is ammonium chloride.

17. A process for producing a boron nitride fiber according to claim 15, wherein in the step (f), the ammonia-treated fiber is stretched at an elongation ratio of at least 12.7%.

18. A process for producing a boron nitride fiber according to claim 15, wherein in the step (f), the ammonia-treated fiber is stretched at an elongation ratio of at least 15.7%.

19. A process for producing a boron nitride fiber according to claim 15, wherein in the step (f), the ammonia-treated fiber is stretched at an elongation ratio of at least 20.1%.

20. A process for producing a boron nitride fiber according to claim 15, wherein in the step (f), the ammonia-treated fiber is stretched at an elongation ratio of at least 24.7%.

21. A process for producing a boron nitride fiber comprising boron nitride having a multi-layered structure consisting of planes (C planes) each formed by linkage of 6-membered rings in the plane, in which boron and nitrogen are positioned alternately and bonded to each other, which fiber has a tensile strength of at least 1,400 MPa, which process comprises:

(a) reacting a boron trihalide-nitrile compound adduct with an ammonium halide or a primary amine hydrohalide in the presence of a boron trihalide to form a boron nitride precursor, (b) dissolving the boron nitride precursor and an acrylonitrile polymer in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

22. A process for producing a boron nitride fiber according to claim 21, wherein in the step (a), the boron trihalide is boron trichloride, the nitrile compound is acetonitrile, and the ammonium halide or the primary amine hydrohalide is ammonium chloride.

23. A process for producing a boron nitride fiber according to claim 21, wherein in the step (b), the acrylonitrile polymer is a polyacrylonitrile.

24. A process for producing a boron nitride fiber according to claim 21, wherein in the step (f), the ammonia-treated fiber is stretched at an elongation ratio of at least 12.7%.

25. A process for producing a boron nitride fiber according to claim 21, wherein in the step (f), the ammonia-treated fiber is stretched at an elongation ratio of at least 15.7%.

26. A process for producing a boron nitride fiber according to claim 21, wherein in the step (f), the ammonia-treated fiber is stretched at an elongation ratio of at least 20.1%.

27. A process for producing a boron nitride fiber according to claim 21, wherein in the step (f), the ammonia-treated fiber is stretched at an elongation ratio of at least 24.7%.

28. A process for producing a boron nitride fiber comprising boron nitride having a multi-layered structure consisting of planes (C planes) each formed by linkage of 6-membered rings in the plane, in which boron and nitrogen are positioned alternately and bonded to each other, which fiber has a degree of orientation of at least 0.74, which process comprises:

(a) reacting a boron trihalide-nitrile compound adduct with an ammonium halide or a primary amine hydrohalide in the presence of a boron trihalide to form a boron nitride precursor, (b) dissolving the boron nitride precursor in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

29. A process for producing a boron nitride fiber according to claim 28, wherein in the step (a), the boron trihalide is boron trichloride, the nitrile compound is acetonitrile, and the ammonium halide or the primary amine hydrohalide is ammonium chloride.

30. A process for producing a boron nitride fiber according to claim 28, wherein in the step (f), the ammonia-treated fiber is stretched at an elongation ratio of at least 12.7%.

31. A process for producing a boron nitride fiber according to claim 28, wherein in the step (f), the ammonia-treated fiber is stretched at an elongation ratio of at least 15.7%.

32. A process for producing a boron nitride fiber according to claim 28, wherein in the step (f), the ammonia-treated fiber is stretched at an elongation ratio of at least 20.1%.

33. A process for producing a boron nitride fiber according to claim 28, wherein in the step (f), the ammonia-treated fiber is stretched at an elongation ratio of at least 24.7%.

34. A process for producing a boron nitride fiber comprising boron nitride having a multi-layered structure consisting of planes (C planes) each formed by linkage of 6-membered rings in the plane, in which boron and nitrogen are positioned alternately and bonded to each other, which fiber has a degree of orientation of at least 0.74, which process comprises:

(a) reacting a boron trihalide-nitrile compound adduct with an ammonium halide or a primary amine hydrohalide in the presence of a boron trihalide to form a boron nitride precursor, (b) dissolving the boron nitride precursor and an acrylonitrile polymer in a solvent to prepare a boron nitride precursor solution, (c) spinning the boron nitride precursor solution to form a boron nitride precursor fiber, (d) preheating the boron nitride precursor fiber in an inert gas atmosphere at 100°–600° C., (e) treating the preheated fiber by ammonia in an ammonia gas atmosphere at 200°–1,300° C., and (f) heating the fiber treated by ammonia in an inert gas atmosphere at 1,600°–2,300° C. with a tensile stress being applied to the fiber.

35. A process for producing a boron nitride fiber according to claim 34, wherein in the step (a), the boron trihalide is boron trichloride, the nitrile compound is acetonitrile, and the ammonium halide or the primary amine hydrohalide is ammonium chloride.

36. A process for producing a boron nitride fiber according to claim 34, wherein in the step (b), the acrylonitrile polymer is a polyacrylonitrile.

37. A process for producing a boron nitride fiber according to claim 34, wherein in the step (f), the ammonia-treated fiber is stretched at an elongation ratio of at least 12.7%.

38. A process for producing a boron nitride fiber according to claim 34, wherein in the step (f), the ammonia-treated fiber is stretched at an elongation ratio of at least 15.7%.

39. A process for producing a boron nitride fiber according to claim 34, wherein in the step (f), the ammonia-treated fiber is stretched at an elongation ratio of at least 20.1%.

40. A process for producing a boron nitride fiber according to claim 34, wherein in the step (f), the ammonia-treated fiber is stretched at an elongation ratio of at least 24.7%.

* * * * *